US005203948A

United States Patent [19]

Suska

[11] Patent Number: 5,203,948

[45] Date of Patent: Apr. 20, 1993

[54] APPARATUS AND METHOD FOR PRODUCING A BENT LAMINATE

[76] Inventor: Alex Suska, 2404 Pinewood Drive, SE., Calgary, Albera, Canada, T2B 1S4

[21] Appl. No.: 760,735

[22] Filed: Sep. 16, 1991

[51] Int. Cl.[5] ..... B27H 1/00

[52] U.S. Cl. ..... 156/443; 144/267; 144/269

[58] Field of Search ..... 144/259-270; 156/443

[56] References Cited

U.S. PATENT DOCUMENTS

| | | | |
|---|---|---|---|
| 1,933,834 | 4/1932 | Wimer . | |
| 3,835,904 | 9/1974 | Sumner . | |
| 3,879,026 | 4/1975 | Lappin, Jr. | 156/443 |
| 3,902,948 | 9/1975 | Morros | 156/443 |
| 4,793,392 | 12/1988 | Gould . | |
| 4,886,568 | 12/1989 | Strozier | 144/263 |
| 4,909,889 | 3/1990 | Strozier | 156/443 |

FOREIGN PATENT DOCUMENTS

| | | |
|---|---|---|
| 390224 | 4/1990 | Austria . |
| 358060 | 2/1920 | Fed. Rep. of Germany . |
| 370139 | 10/1906 | France . |

*Primary Examiner*—David A. Simmons
*Assistant Examiner*—William J. Matney, Jr.
*Attorney, Agent, or Firm*—James D. Hall

[57] ABSTRACT

An apparatus and method is disclosed for the bending and pressing of laminations into 2-dimensional or 3-dimensional curves. The apparatus includes a pair of spaced apart rotatable clamps for the clamping of the laminations at spaced apart locations. At least one of the clamps is movable towards the other clamp. Counter-clockwise rotation of the clamps bends the laminations held by the clamps. A clamping force of at least one of the clamps is controllable so that the laminations may be bent while a mutual sliding movement of the laminations in at least one clamp is permitted. The laminations are bent to a radius larger than a desired radius. At this point, the clamping pressure is increased to prevent the mutual sliding movement so that upon further bending of the laminations, the outer laminations are pressed against the inner laminations at a substantially evenly distributed force along the bent section of the laminations. The apparatus is easily adaptable to produce different shapes and sizes of 2- and 3- dimensional curvatures and permits the fast and economical bending and compression of a workpiece having individual layers.

21 Claims, 8 Drawing Sheets

APPARATUS AND METHOD FOR PRODUCING A BENT LAMINATE

BACKGROUND OF THE INVENTION

1. Technical Field

The invention relates to apparatus and methods for bending and pressing into curved shaped workpieces having a plurality of layers. More specifically, the invention relates to an apparatus and method for bending and pressing laminations into 2-dimensional or 3-dimensional curves without using a mold, form or adjustable jig.

2. Discussion of the Prior Art

Curved wood forms having circular, oval, hyperbolic, elliptical or similar shapes may be achieved by the steam bending of solid wood, or by bending a stack of laminates and intermediate glue into a desired shape. Laminated curved wood parts are usually preferred over curved parts made of solid wood, since they are of superior strength and stability. Furthermore, unset laminates generally require less bending force than solid wood parts. However, to achieve a satisfactory curved wood part, the laminates must not only be bent, but must also be held after bending in the exact position and shape desired until the glue or adhesive is set or cured. In addition, substantial pressure must be applied to compress the laminations of a workpiece during the setting of the glue and the created pressure must be evenly distributed along the workpiece to achieve a bent laminate of uniform consistency and quality. A number of prior art apparatus and methods have been proposed for the bending of unset laminates, however, these apparatus are expensive, difficult to adjust to different curvatures, not applicable for the production of two dimensional as well as three dimensional curvatures, or require specific molds or patterns for each size and shape of curvature to be produced.

German published application DE 2,251,497 by Mayer teaches an apparatus for the manufacture of laminated handrails for spiral stairs. The apparatus includes a vertical post and a number of horizontal braces which represent the steps of a spiral staircase. Each horizontal brace has a sleeve, which is guided along the post and is affixed to one subunit of a folding steel trellis. The top and bottom sleeves include an interior thread which engages a complementary thread on the post. Rotation of the post increases or decreases the length of the foldable steel trellis so that any height and rising angle of the spiral staircase can be adjusted. The apparatus further includes vertical brackets, which are slidably mounted on the horizontal braces for adjustment of the radius of the handrail. The unset handrail laminate is positioned along the outside of the vertical brackets and pressed against the brackets by a steel plate tensioned along the outside of the laminate. Thus, time consuming adjustment of both the horizontal braces and the vertical brackets is required for the achievement of a handrail of a different radius or rise and run. Furthermore, the published application does not teach the production of 2-dimensional curvatures.

The same applies to the apparatus described in German published application DE 1,728,013 also by Mayer. This apparatus is of the same basic construction as the one disclosed in DE 2,251,497 except that the sleeves are not freely slidable along a vertical post but are all threaded and each engage a complementary thread extending the whole length of the post.

U.S. Pat. No. 3,902,948 by Morros discloses an apparatus similar in construction to the apparatus discussed above, which is used for the forming of stringers of curved stairways. The stringer is formed by placing a stack of pre-glued laminations in a pair of holding brackets mounted on each of a number of horizontal beams, which are carried by a vertical central post and represent the steps of the stairway. A stiffener board is placed along the stack of laminates and in the holding brackets. Air tubes are positioned between the laminates and the stiffener board and are inflated to press the laminations together. Again, time consuming adjustment is required for the production of stringers of different radii or rise and run. Also, the assembly time of the laminates in the apparatus together with the stiffener board and the air tubes is unsatisfactory.

U.S. Pat. No. 4,886,568 by Strozier teaches an adjustable radius wood laminate bending and gluing fixture, for the bending and compressing of a stack of laminations and adhesive between two flexible bands that are drawn against adjustably positioned stanchions. The position of the stanchions in radial slots in a bed defines the desired curve for the workpiece. The bands are tensioned by cables, which pass through appropriate pulleys and attach to the band ends. However, in order to adjust the fixture to different radii, the stanchions must be moved.

U.S. Pat. No. 4,909,889 by Strozier discloses a wood laminate bending apparatus wherein laminations are drawn against curve-defining plates or patterns by a belt of adjustable length, which is attached to a rack and is tensioned by movement of the rack away from the plates or patterns. The curve-defining plates or patterns are interchangeable but each provide only one specific curvature. Other laminate bending and gluing apparatus are disclosed in U.S. Pat. Nos. 1,954,183; 3,205,110; 4,089,732; DE 3,046,088; GB 1,391,077 and GB 1,391,078.

Thus, an apparatus is desired which is easily adaptable to different shapes and sizes of 2- and 3-dimensional curvatures and permits the fast and economical bending of a workpiece having individual layers.

SUMMARY OF THE INVENTION

The invention now provides an apparatus and method for producing a bent workpiece, wherein one or more layers of a flexible material are held in clamping means at spaced apart locations. Rotation of the clamping means bends the layers between the clamping means. The layers are bent to a radius larger than a desired radius while permitting mutual sliding movement of the layers. Subsequently, the mutual sliding movement is prevented and the layers are bent to the desired radius, whereby the layers of the curved workpiece force against each other, which provides a substantially even compression of the layers along the whole length of the bent workpiece.

Preferably, the invention provides an apparatus for producing a bent laminate of at least two continuous laminations of a flexible material, comprising first and second clamping means for clamping together the laminations at spaced apart clamping locations and means for rotatably supporting the clamping means. The first and second clamping means are respectively rotatable around first and second axes of rotation. At least one of the clamping means is movably supported for movement towards and from the other clamping means. The apparatus further comprises means for selectively rotating at least one of the clamping means to permit the bending of laminations held by the clamping means; and means for selectively preventing mutual sliding movement of the laminations. The axes of rotation are positioned so that a bending of the laminations, when the mutual sliding movement is prevented, forces the laminations against each other at a substantially evenly distributed force between the clamping locations. The laminations are of sufficient strength to withstand the force created.

In another preferred embodiment, the apparatus in accordance with the invention further includes a flexible pressure band, which may be clamped to the laminations by first and second clamping means. At least one of the clamping means may be rotated to permit bending of the laminations clamped to the pressure band. The means for selectively preventing a sliding movement, prevent the mutual movement of the laminations and the pressure band. Bending of the laminations and the pressure band, while the mutual sliding movement is prevented, forces the pressure band against the laminations at a substantially evenly distributed force between the clamping locations.

In yet another preferred embodiment, the apparatus includes a pair of pressure bands for clamping the laminations of a laminate therebetween. The means for selectively preventing a sliding movement provides for the prevention of a mutual sliding of the pressure bands.

The means for rotatably supporting the clamping means is preferably a frame having first and second horizontal rotatable carriers supporting the first and second clamping means respectively. At least one of the first and second carriers is preferably slidably mounted to the frame for movement to and from the other of the first and second carriers.

In still another preferred embodiment of the apparatus in accordance with the invention, the means for selectively rotating at least one clamping means includes for each clamping means to be rotated, a rotatable shaft, means for rotating the shaft, preferably an electric motor providing a torque and being connected to the shaft through a transmission for increasing the torque, and a lever rigidly affixed with its respective ends to the shaft and to the one of the first and second carriers, so that rotation of the shaft rotates the clamping means supported by the one carrier around its axis of rotation.

The means for selectively preventing mutual sliding movement of the laminations, the pressure band, or the pair of pressure bands, preferably controls a clamping force of at least one of the first and second clamping means to selectively clamp the laminations, the pressure band, or the pair of pressure bands at a low clamping force permitting mutual sliding movement of the laminations or the bands and a high clamping force where the mutual sliding movement of the laminations or the bands is inhibited. The clamping force of one of the first and second clamping means is preferably controlled to prevent the mutual sliding movement and the clamping force of the other clamping means is preferably controlled to selectively clamp the laminations, the pressure band or the pair of pressure bands at the high and the low clamping force. The innermost or outermost of the laminations or one pressure band is preferably prevented from sliding through the first and second clamping means.

At least one of the clamping means is preferably movable parallel to its axis of rotation.

The invention further provides a method of producing a bent laminate having at least two continuous flexible laminations comprising the steps of clamping together the laminations at spaced apart clamping locations and at a clamping force permitting mutual sliding movement of the laminations;

bending the layers between the clamping locations to a radius of curvature larger than a desired radius of curvature;

preventing the mutual sliding movement of the laminations; and further bending of the laminations to the desired curvatures so that the laminations are forced against each other at an even pressure along the curvature.

The laminations may also be clamped to one or a pair of pressure bands, whereby mutual sliding movement of the laminations and the pressure plate or mutual sliding movement of the two pressure plates relative to each other is selectively prevented.

DETAILED DESCRIPTION OF THE PREFERRED EMBODIMENT

Figure 1:
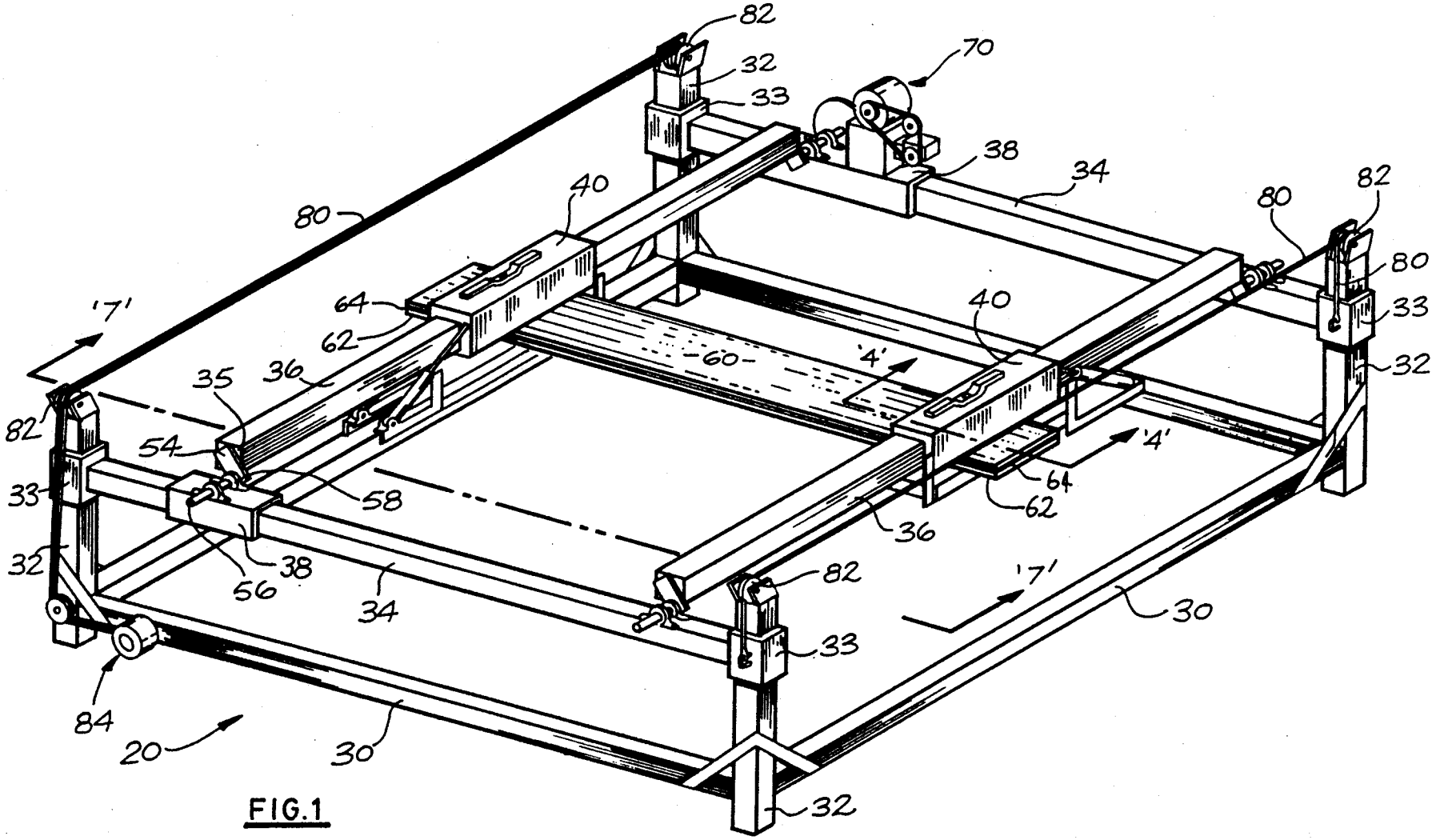
FIG. 1 is an isometric view of the preferred embodiment of an apparatus in accordance with the invention, adjusted to produce a 2-dimensionally curved laminate.

In the preferred embodiment of an apparatus in accordance with the invention as shown in FIG. 1 and in the following generally referred to by reference numeral 20, a stack of pre-glued laminations 64 is held by clamps 40 at spaced apart locations between a pair of pressure bands 60 in such a way that the pressure bands 60 may slide against each other in the clamps 40. One of rotatable carriers 36 is actively rotated by means of a drive assembly 70, which rotation causes bending of the laminations 64 and pressure bands 60, and passive rotation of the other, freely rotatable carrier 36. The rotation is continued until the laminations 64 are bent to a radius selectively larger than a desired radius. At this point the clamping force of clamps 40 is increased to prevent the mutual sliding of the pressure bands 60 relative to each other. Further rotation of rotatable carriers 36 forces the pressure plates 60 against each other to compress the laminations 64 at a force, which is substantially evenly distributed over the bent portion of the laminations 64. After the glue has set, the produced bent laminate may be removed from the apparatus 20 and the carriers may be returned to their original position for reloading of the apparatus.

Figure 2:
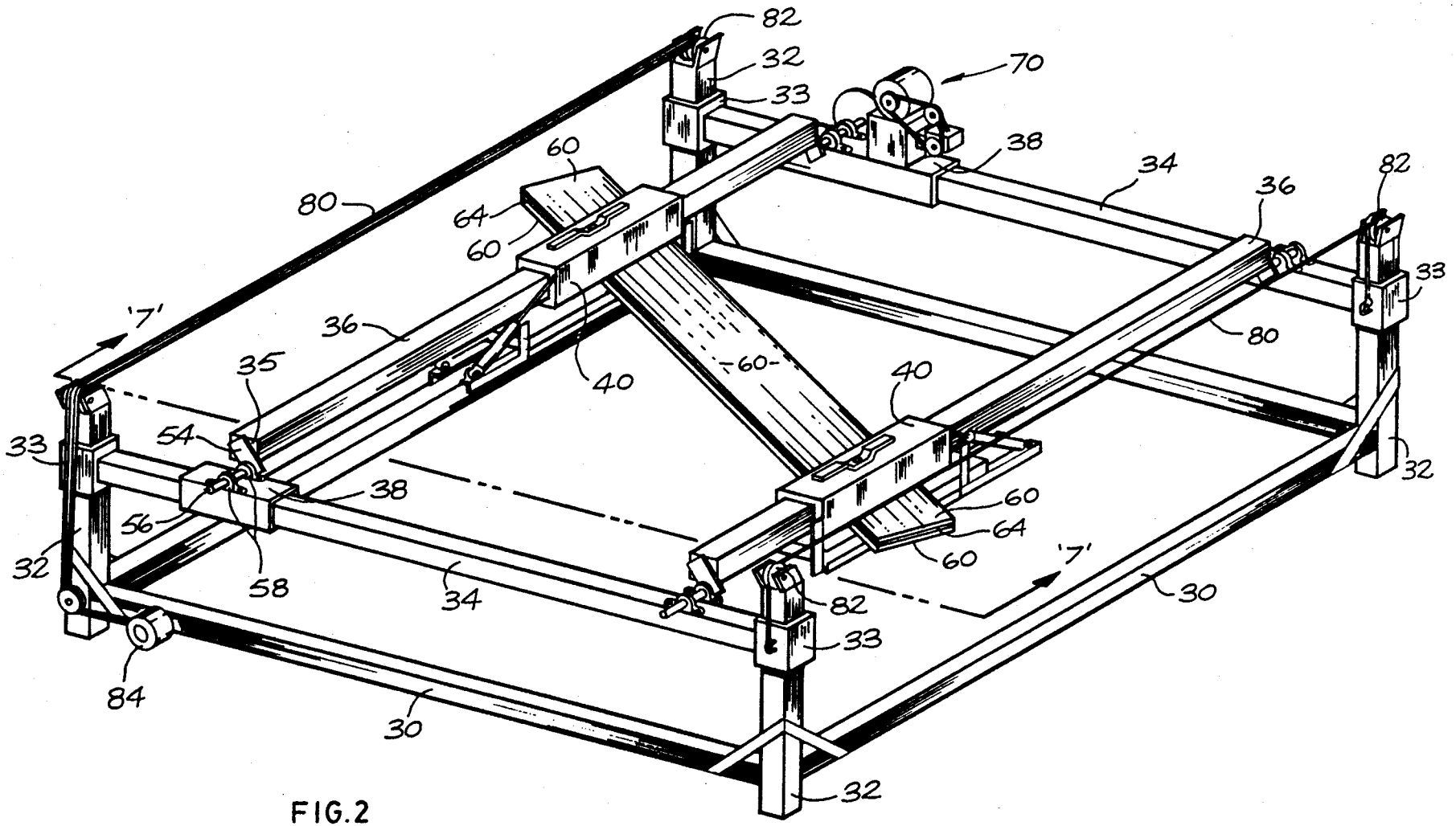
FIG. 2 illustrates the apparatus shown in FIG. 1 adjusted to produce a 3-dimensionally curved laminate.

Turning now to FIGS. 1 and 2, the apparatus 20 includes in detail a rectangular frame 30 which is made of square steel tubing and has vertical posts 32. Horizontal supporting beams 34 are vertically slidably mounted on posts 32 by vertical sleeves 33. A pair of parallel rotatable carriers 36 which each support a clamp 40 extend at a right angle to and between supporting beams 34. One of the pair of rotatable carriers 36 is rotatably affixed at its respective ends to a mounting sleeve 48 through a lever plate 54, which is welded to an end plate 35 of the rotatable carrier 36 and a shaft 56 respectively. Shaft 56 is affixed to the mounting sleeve 48 by bearings 58. Each mounting sleeve 48 is freely slidable on one of the horizontal supporting beams 34. The other rotatable carrier 36 is in a similar way rotatably affixed at its ends directly to the supporting beam 34 through lever plate 54, shaft 56 and bearings 58. First rotatable beam 36 is rotatable by a driving assembly 70, which will be discussed in more detail below with reference to FIGS. 5 and 6. Clamps 40 are movably supported on carriers 36 in a manner described below with reference to FIG. 4.

The clamping force of clamps 40 is controllable for the selective clamping of a pair of pressure bands 60 and intermediate laminations 64 at a low clamping force permitting the pressure bands 60 to slide relative to each other in one or both of clamps 40 during bending of the laminations 64 and at a high clamping force preventing the pressure bands 60 to slide relative to each other. The pressure bands are laminated wood bands consisting of 6 layers of miscellaneous wood veneer to attain a strong, tensile, yet flexible character. It will be known to a person skilled in the art that such laminated wood bands are said to have a shape memory. The pressure bands 60 are of the same width or wider than laminations 64 to prevent marks on the laminations. Both the supporting beams 34 are adjustable in height by cables 80, which are attached with one end to sleeves 33, are guided over pulleys 82 at the top end of posts 32 and are with their other end attached to a cable winding mechanism 84 for the winding and unwinding of cables 80. Other pulleys (not illustrated) are used to guide all cables 80 to the cable winding mechanism 84. A shortening of cables 80 raises the supporting beams 34 and unwinding of cables 80 lowers them.

In FIG. 1, clamps 40 are positioned so that pressure bands 60 and laminations 64 extend rectangularly to the rotatable carriers 36. Thus, counter rotation of carriers 36 will produce a bent laminate having a 2-dimensional curvature. However, when the clamps 40 are positioned in the way shown in FIG. 2, so that the pressure bands 60 and laminations 64 do not extend rectangularly to the rotatable carriers 36, a bending of the laminations 64 will produce a laminate having a 3-dimensional curvature. It will be readily appreciated by the person skilled in the art, that a bending of the laminations 64 shown in FIGS. 1 and 2 will lead to a movement of the slidably supported rotatable carrier 36 towards the stationary rotatable carrier 36 along supporting beams 34. The working principle of the bending apparatus 20 and the adjustment of the apparatus for the production of a curved laminate of a specific desired radius for 2-dimensional curvatures and a specific radius and rise and run for 3-dimensional curvatures will be described below with reference to FIGS. 8*a* to 8*c*.

Figure 3:
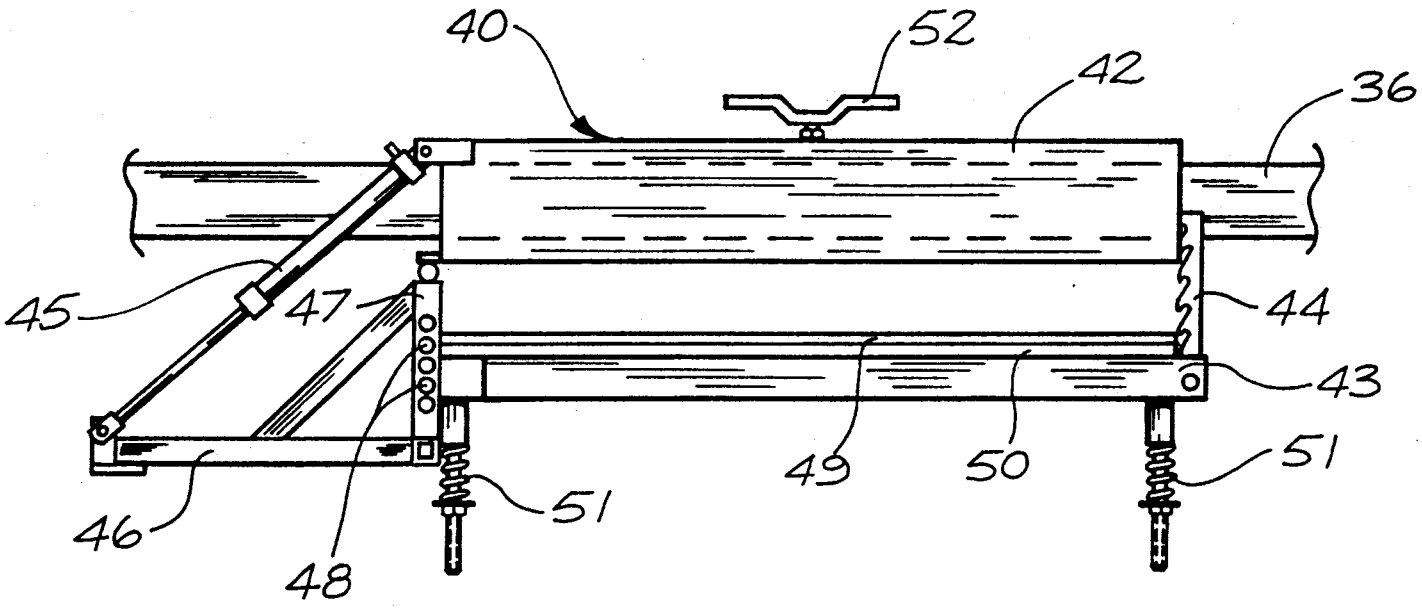
FIG. 3 is an enlarged side view of a clamp of the apparatus shown in FIG. 1.

Turning now to FIG. 3, each clamp 40 includes a support sleeve 42 which represents the upper jaw of clamp 40 and is movably mounted on clamp carrier 36 in a manner described below with reference to FIG. 4. The lower jaw of clamp 40 is provided by a rectangular jaw frame 43 which is made of angled steel sections and is at one end adjustably hooked to support sleeve 42 by a pair of toothed bars 44 (only one shown). The jaw frame 43 is at the opposite end connected to supporting sleeve 42 by a pair of pneumatic cylinders 45 (only one shown) for the opening and closing of the clamp 40. Toothed bars 44 hook into a bottom wall of support sleeve 42, which is made of a square steel section. A cylinder mounting bracket 46 has a pair of upstanding sections 47 which together with toothed bars 44 provide lateral stops for any laminations to be clamped. Upstanding sections 47 are provided with holes 48 for the variable adjustment of cylinder mounting bracket 46 to jaw frame 43 by bolts (not illustrated). A pressure plate 49 may be forced by an inflatable air bag 50 against laminations held in clamp 40. Compression springs 51 pull pressure plate 49 against inflatable air bag 50 for deflation of the air bag 50 when no pressurized air is supplied thereto. Pressurized air is supplied to pneumatic cylinders 45 and air bag 50 through appropriate tubing known in the art. A winged bolt 52 is provided in support sleeve 42 for the releasable frictional engagement of carrier 36 to prevent the sliding of clamp 40 along the carrier 36. One of the upper and lower jaws of each clamp 40 is provided with spurs (not illustrated), which are pushed into a respectively adjacent pressure band 60 during clamping, in order to prevent sliding of this pressure band through the clamps 40 at both a low and a high clamping force.

Figure 4:
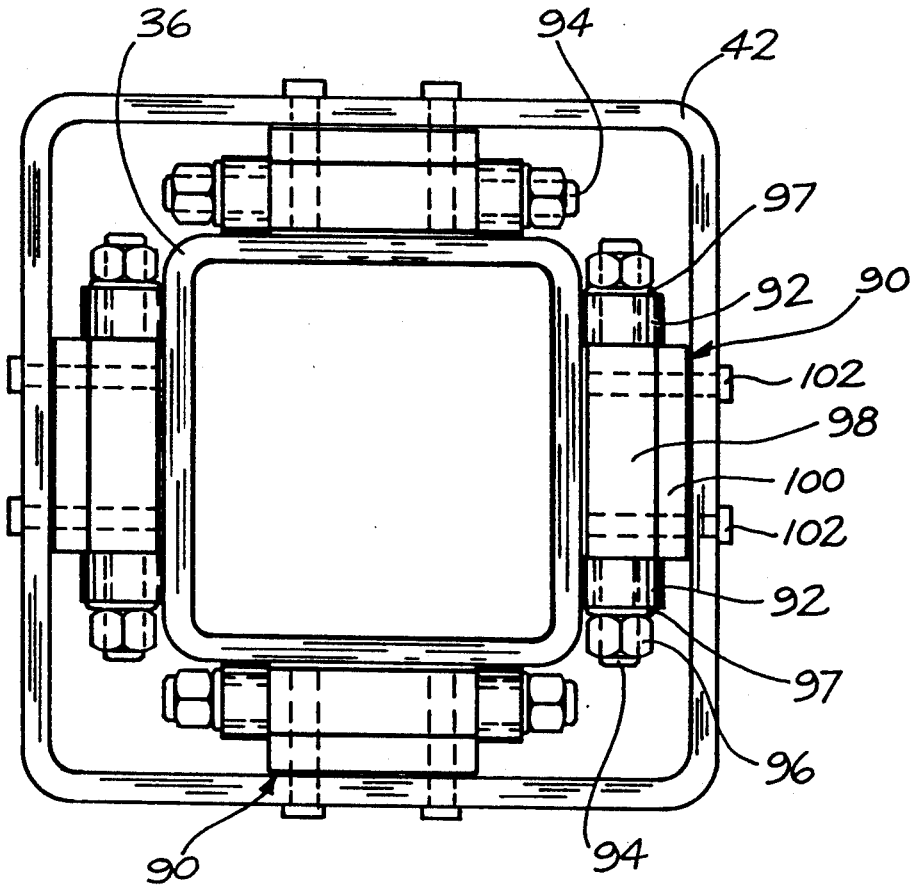
FIG. 4 is a section along line 4—4 through the apparatus shown in FIG. 1.

FIG. 4 illustrates the manner in which the support sleeves 42 and mounting sleeves 38 are movably supported on carriers 36. Four sets of roller assemblies 90 are mounted to the inside of the side, top and bottom walls at the ends of each sleeve. Roller assemblies 90 each include a pair of rollers 92 which engage a side wall or the top or bottom wall of one of the rotatable carriers 36 or supporting beams 38. Rollers 92 are rotatably mounted to a bearing block 98 by a threaded rod 94 extending through bearing block 98 and are held on rod 94 by nuts 96 and washers 97. Bearing blocks 98 are in turn fastened to the inside of the sleeves side, top and bottom walls by bolts 102. Rubber shims 100 are positioned between the bearing blocks 98 and the sleeves to absorb size tolerances and surface unevenness of carriers 36 and beams 38 and to prevent damage thereto during the bending operation.

Figure 5:
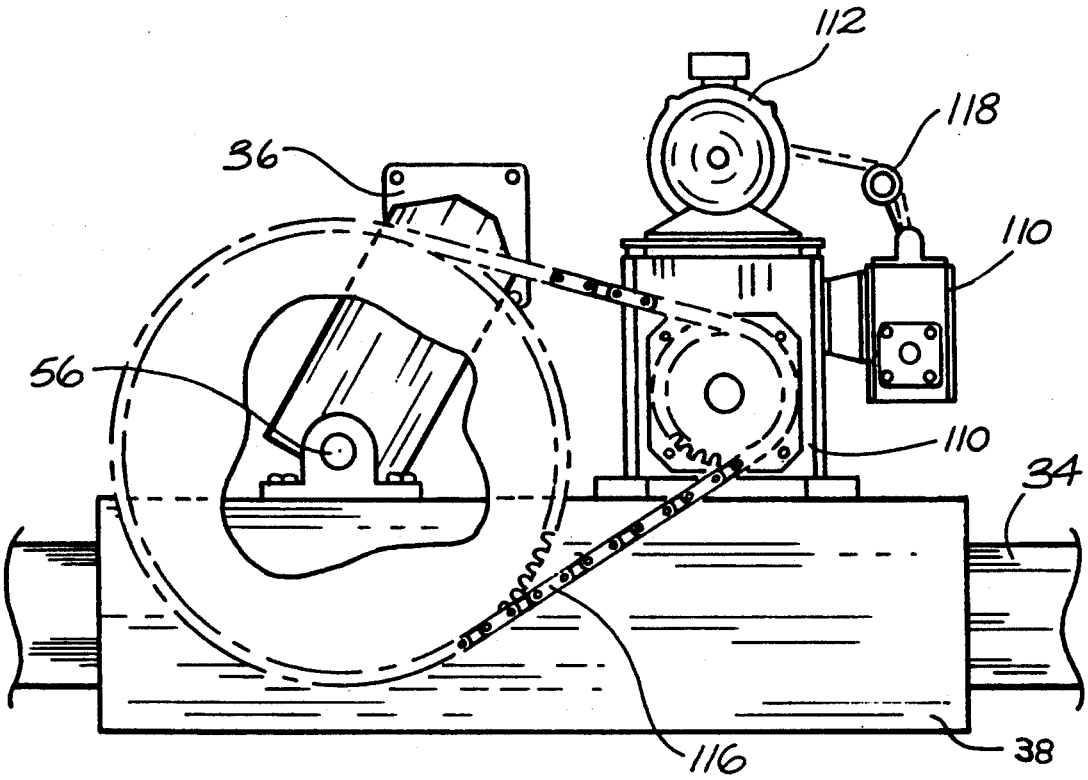
FIG. 5 is an enlarged end view of the driven rotatable carrier of the apparatus shown in FIG. 1.
Figure 6:
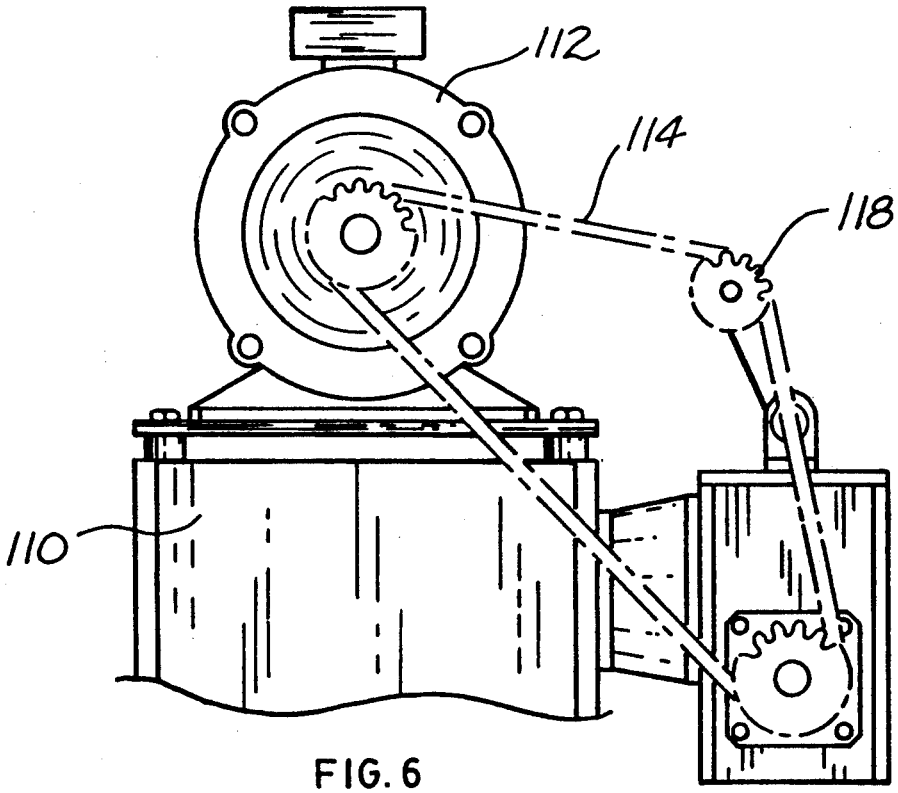
FIG. 6 is a view from an opposite direction of the detail shown in FIG. 5.

Turning now to FIGS. 5 and 6, drive assembly 70 includes a transmission 110, a ½hp electric motor 112, a first chain and sprocket drive 114 connecting the motor 112 with the transmission 110 and a second chain and sprocket drive 116 connecting the transmission 110 with the rotatable shaft 56 of rotatable carrier 36. Motor 112 is bolted to the top of transmission 110, which in turn is bolted to a mounting sleeve 38 and adjacent to the shaft 56 of a rotatable carrier to be driven by assembly 70. The first chain and sprocket drive 114 is mounted on the inner side of motor 112 and transmission 110 towards clamps 40 and the second chain and sprocket drive 116 is mounted on the outer side of motor 112 and transmission 110. First chain and sprocket drive 114 includes a spring loaded chain tensioning sprocket 118. The overall transmission ratio of drive assembly 70 is 6,000 to 1.

Figure 7A:
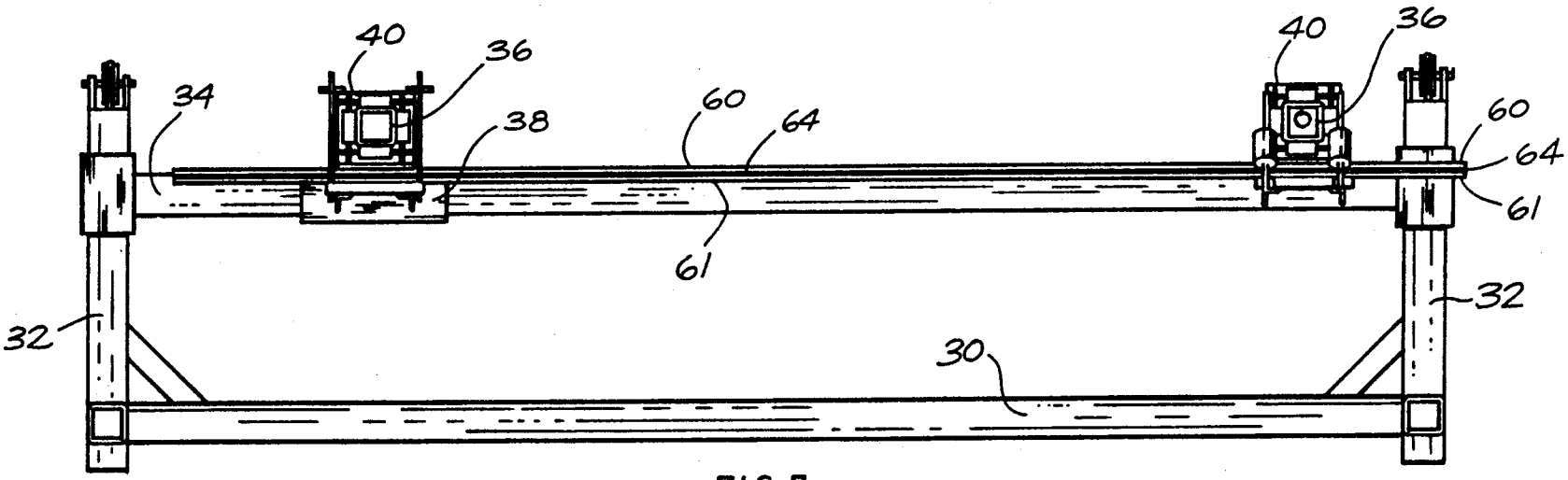
FIG. 7 is a cross-section taken along line 7—7 in FIG. 1 with the laminate in an unbent condition.
FIG. 7*b* is a cross-section taken along line 7—7 in FIG. 1, with the laminate in a bent condition.
Figure 7B:
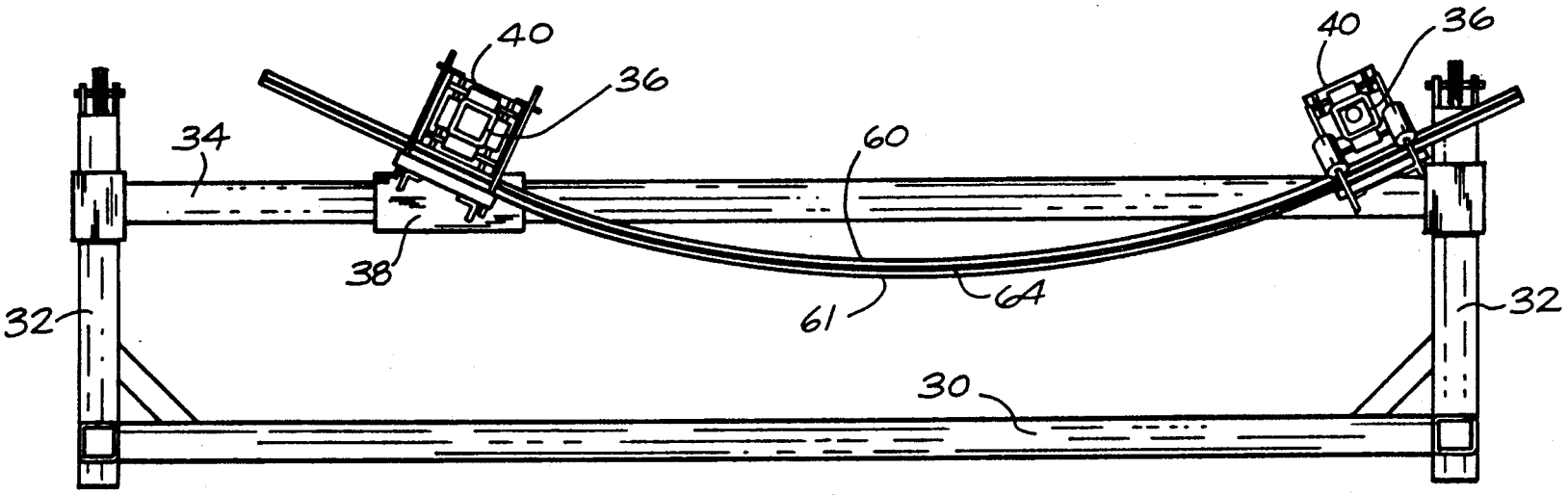

As will be apparent from FIGS. 7*a* and 7*b*, carriers 36 and, thus, clamps 40 are rotated in opposite directions during bending of laminations 64 held between pressure bands 60 by clamps 40. Simultaneously, carriers 36 and clamps 40 are tilted towards each other through the action of lever plate 50 (see FIGS. 1 and 2) during rotation of the clamps 40 around their respective axes of rotation 120. Thus, the weight of the carriers 36 and clamps 40 is used as additional rotational force to generate more torque. It is further apparent that the axes of rotation 120 coincide with a central plane of the laminations 64 and are located at the opposing edges of clamps 40. Thus, the partial circumference of an arcuate bent laminate as shown in FIG. 7*b* and produced by an apparatus in accordance with the invention corresponds to the distance between the clamps 40 or the length of the laminations between clamps 40, in the original set up shown in FIG. 7*a*. This facilitates the adjustment of an apparatus in accordance with the invention for the production of laminates of different length or circumference. The adjustment of the apparatus for the production of 2-dimensional and 3-dimensional laminates of different length, circumference or radius and rise and run will be explained in more detail below by way of example and with reference to FIGS. 8*a* to 8*c*.

The pneumatic pressure produced in clamps 40 by pneumatic cylinders 45 and air bags 50 (see FIG. 3) may be utilized to compress the laminations in clamps 40. Thus, a curved laminate may be produced having straight end sections, which combine geometrically with the curvature of the laminate at precise tangents relative to the radius of the curvature.

During operation, the laminations of a workpiece to be bent are bundled and are placed in open clamps 40 together with and between pressure bands 60. The distance of clamps 40 is adjusted to the length of the desired curved laminate and clamps 40 are adjusted by way of toothed bars 44 to the total thickness of pressure bands 60 and laminations 64 and are closed by activating the pneumatic cylinders 45. The air bags 50 of the clamps 40 are pressurized to achieve a low clamping force which allows a gradual mutual sliding movement of the pressure bands 60 during bending. Spurs (not shown) on the lower jaws of clamps 40 prevent the lower pressure band 60 from sliding through either of the clamps 40, which guarantees that the originally adjusted length of the desired curved laminate is maintained. Operation of motor 112 directly rotates one of carriers 34 which leads to a bending of laminations 64 and pressure bands 60 and the corresponding rotation of the other carrier 36. The bending continues until a radius of curvature is achieved which is selectively larger than the radius of curvature of the desired curved laminate. At this point, the clamping force of clamps 40 is increased from the low clamping force to a high clamping force, which prevents the mutual sliding movement of the pressure bands 60. Further bending of the laminations 64 to the curvature of the desired laminate will then cause the pressure bands 60 to force against each other, since the inner pressure band remains of the same clamped length as the other pressure band. According to the classical geometry of the arch, the pressure bands force against each other at a pressure which is evenly distributed along the curvature of the bent workpiece between clamps 40. A person skilled in the art will readily appreciate that the pressure bands 60 must be of a material able to withstand the forces created. The rigidity requirements for pressure bands 60 are directly related to the ultimate curvature desired and to the amount of pressurization required for a satisfactory lamination. The art skilled workman will further appreciate that the amount of pressure created is proportional to the degree of bending after the mutual sliding of the pressure bands 60 is inhibited and is also dependent on the kind of material used for the pressure bands 60. Furthermore, the accuracy of the arch or helical arch created is directly related to the rigidity of the pressure bands 60, the force inhibiting the mutual sliding movement of the pressure plates, the amount of pressure created, the degree of manipulation of the chord measure of the arc or the distance between clamps 40, and the torque or rotation created. Bent laminates having a helical curvature are produced in a similar way by initially clamping laminations 64 and pressure bands 60 at an angle relative to carriers 36, which is more or less than 90°. The subsequent operation of the apparatus for bending the laminations to achieve the helically curved workpieces is the same as the one described above. If the resulting helically curved laminate is intended for use as a stringer in a helical staircase, the difference from 90° of the angle of the laminations in the initial set up relative to carriers 36 determines the rise of the stringer and the clamped length of the laminations 64 determines the run of the stringer.

Figure 8A:
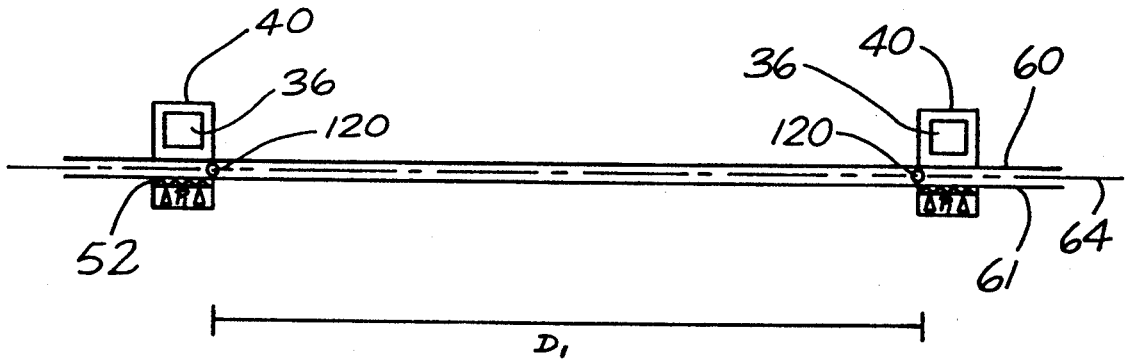
FIGS. 8*a*, *b* and *c* schematically illustrate the working principle of the apparatus shown in FIG. 1.

The adjustment operation of an apparatus in accordance with the invention will now be further described with reference to FIGS. 8*a* to 8*c* for the production of an exemplary arched laminate, which has an outer circumference of the arc of 123 inches ("), an angle of 90° and is made of pre-glued laminations of a total thickness of 2". For the initial set up illustrated in FIG. 8*a*, the pre-glued laminations 64 are positioned between upper and lower pressure bands 60 and 61. Clamps 40 are adjusted to a distance of 123" and then closed by operation of the pneumatic cylinders 45 (see FIG. 3). The air bags 50 (see FIG. 4) of clamps 40 are inflated to a pressure $P_1$ of 20 psi to force the lower pressure band 61 against spurs 53 in the lower jaws of clamps 40 so that a sliding of lower pressure band 61 through the clamps 40 is prevented during the rotation procedure to follow. Thus, the clamped length of lower pressure band 61 will remain constant during bending, which ensures the production of a curved laminate having an outer circumference of 123".

Figure 8C:
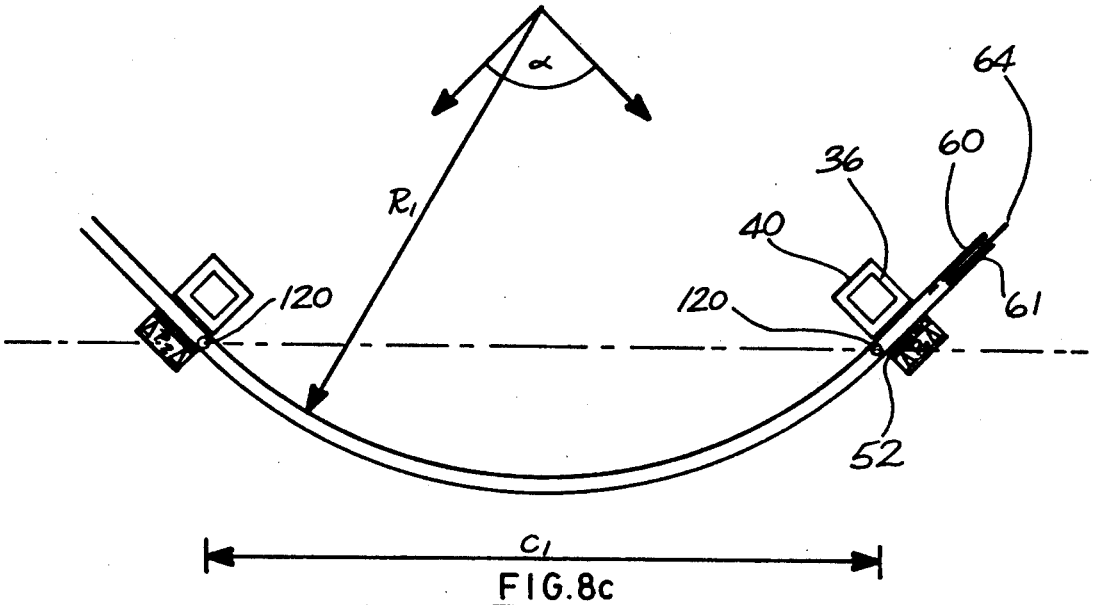
Figure 8B:
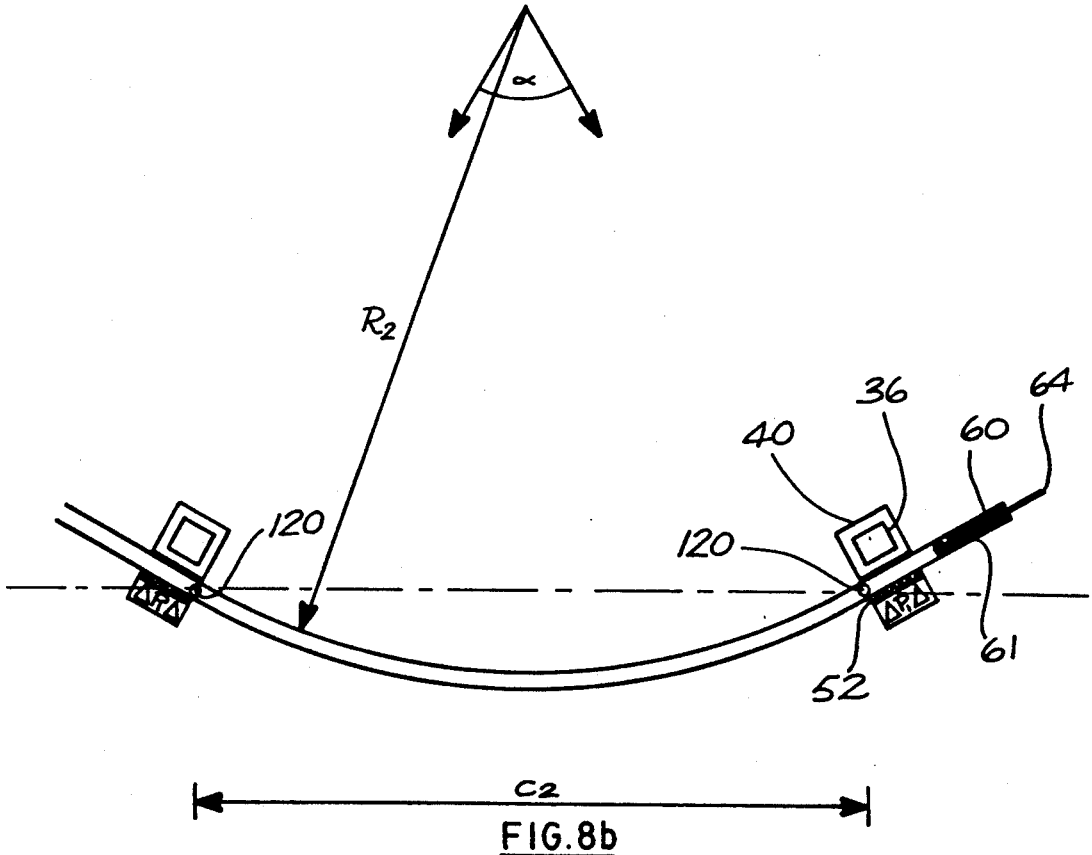

Turning now to FIG. 8*b*, carriers 36 are partially rotated around axes 120 by a total of 60° to produce a bent workpiece having an arc of 60° angle. Since lower pressure band 61 did not slide through clamps 40, the outer circumference of the arc is 123". The distance between the axes of rotation 120 or clamps 40 has decreased from initially 123" to 119.02", which represents the chord measure of the arc. The chord measure may be calculated by the formula $$C = \frac{2R}{\sin \frac{\alpha}{2}}$$

wherein the R is the radius of the arc and alpha is the angle of the arc. The radius of the arc can be calculated by using the formula $$R = \frac{\text{circumference}}{2\pi}$$

If the partial circumference of the 60° arc=123", then the full circumference of the 360° arc=6×123"=738". Thus, the radius of the arc in this example is $$R1 = \frac{738''}{6.28} = 117.52''$$

An arc of 60° having a radius of 117.52" is produced. The inflation pressure $P_1$ of air bags 50 (see FIG. 3) was maintained during rotation permitting the upper pressure band 60 to slide relative to lower pressure band 61. At this point, the air bags are inflated at a higher pressure $P_2$ of 70 psi, which clamps upper pressure band 60 at a clamping force that inhibits the upper pressure band from sliding relative to the lower pressure band 61.

In FIG. 8c, carriers 36 are rotated a total of 90° and the distance between clamps 40, the chord measure of the arc, is further reduced to 112.9". Using the above calculation, the resulting radius R2 of the arc is 78.34". A person skilled in the art will readily appreciate, that for the production of an arcuate laminate having a larger or smaller radius, the clamped length of lower pressure band 61 must be increased or decreased accordingly. The required clamped length can be easily determined by applying the above formulas.

The principles discussed above also apply for the production of a bent laminate having a helical curvature. The slope of a helically curved laminate produced with an apparatus in accordance with the invention is determined by the distance by which clamps 40 are offset relative to each other in a direction parallel to carriers 36. For the production of a helical laminate having a rise of 100" and a run of 123 inches, clamps 40 and thus laminations 64 are offset in the initial set up by 100" and the clamped length of lower pressure band 61 is adjusted at 123". During the bending operation, the slope of lower pressure band 61 remains constant. However, the radius of the bent workpiece decreases and so does the distance between clamps 40. This causes the slope of the upper pressure band 60 to change. Thus, it is important that the upper pressure band 60 is allowed to slide along its circumference relative to the lower pressure band 61 and is permitted to slide in clamps 40 to allow a change in its slope, in order to achieve a 3-dimensionally bent laminate having an ideal curvature.

Although the jaws of clamps 40 are only 10 inches wide in this preferred embodiment, secondary platens may be used to extend the jaws of clamps 40 to any desired width for the production of straight end sections of any desired length. Furthermore, curved platens may be incorporated into clamps 40 to extend their jaws and to provide for the production of curved laminates having, for example, S-shaped end sections. Of course, it is also possible to attach additional straight platens between or onto pressure bands 60 and between clamps 40 in order to produce curved laminates having intermediate straight sections. In addition, pressure bands 60 may be reinforced in selected areas for the production of laminates having a changing curvature.

Although spurs are preferably provided on the lower jaws of clamps 40 to engage the pressure band, which comes to rest against the outer circumference of the curved laminate, only the upper jaws or both jaws of the clamps 40 may be provided with spurs or mechanical equivalents. When both jaws are equipped with spurs or the like, the spurs in the upper jaw are preferably covered with a padding of rubber or elastic foam material, which will yield at the higher clamping force only. Thus, the pressure band 60 adjacent the upper padding may slide along the jaw until the higher clamping force is applied, which then forces the spurs into engagement with the pressure band. However, it is always preferable to prevent the sliding through clamps 40 of the in the curved configuration outer pressure band in order to prevent a diverging movement of the individual pieces of non-continuous laminations.

Curved laminates having oval, elliptical, hyperbolic or similar curvatures may be produced by rotating carriers 36 and, thus, clamps 40 to a different degree to create a helical progression in the curvature of the laminate and/or by manipulating the distance of the clamps in a manner readily apparent to a person skilled in the art. These curvatures may also be produced by forcing a bent laminate against the surface supporting the apparatus, in general the floor of a workshop, by moving support beams 34 downwardly on posts 32 through cables 80 and cable winding mechanism 84. Furthermore, by successively clamping different sections of a laminate, curved laminates having compound curvatures may be produced.

Figure 9:
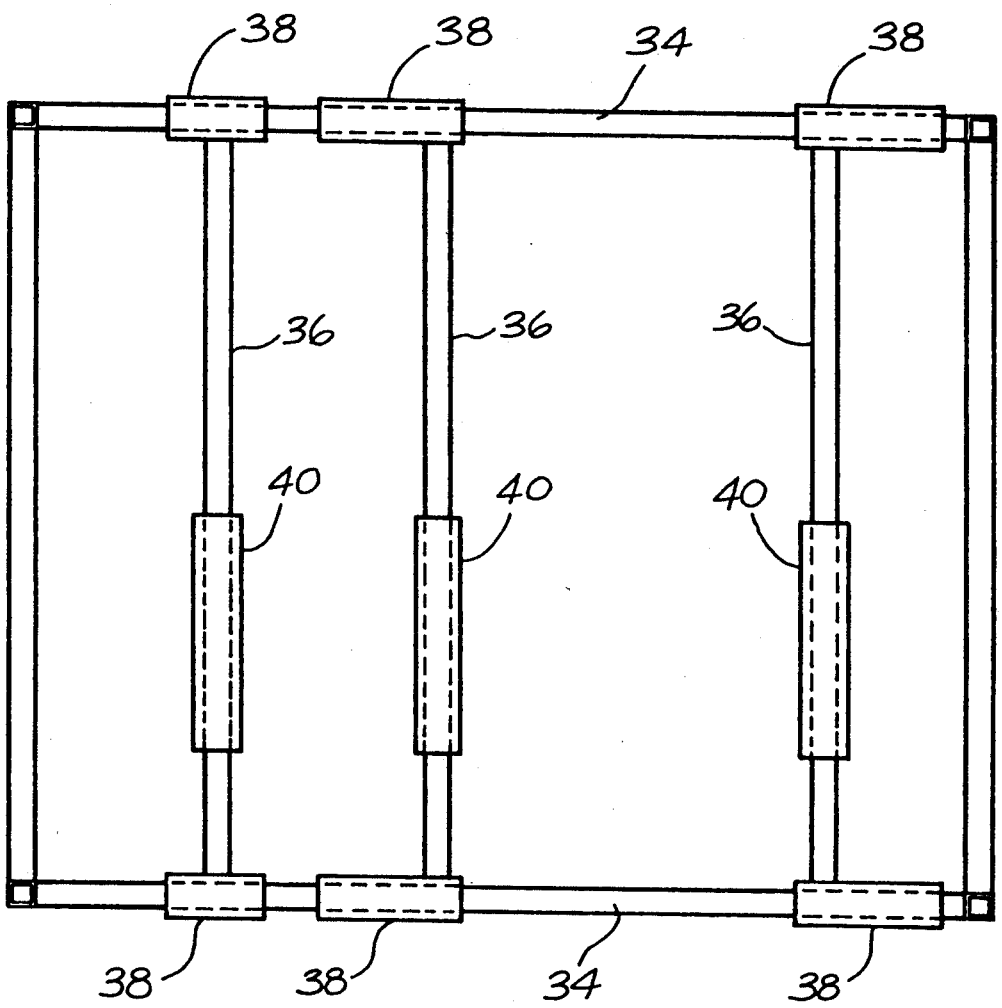
FIG. 9 illustrates a preferred embodiment of the apparatus shown in FIG. 1, having three clamps.

Curved laminates having a compound curvature and even reverse curves may be produced in one manufacturing cycle by an apparatus in accordance with the invention, which includes a third clamp 40 as shown in FIG. 9. Two of the three clamps 40 are slidably mounted on a pair of parallel rotatable carriers 36, which are movable along supporting beams 34. The third clamp 40 is slidably mounted on a stationary rotatable carrier 36, which is positioned parallel to the pair of movable carriers 36. A laminate of reverse curvature may thus be achieved by rotating the outer of clamps 40 in the same direction and rotating the intermediate clamp in an opposite direction.

It will be readily apparent to a person skilled in the art, that the pressure bands may be constructed differently than described above and may be made of a material other than wood such as plastic or metal as long as they are able to withstand the forces created during bending and pressing. Furthermore, the pressure bands may be provided with a heating arrangement permitting the use of a heat setting adhesive or to shorten the setting time of regular adhesives. The heating may be removably or permanently affixed to the inner or onto surface of the pressure bands, for example, in form of heatable sheets or bands.

The pressure bands 60 may be completely omitted if the laminations to be bent by the apparatus are continuous and are of sufficient strength to provide a sufficient pressure force for satisfactory compression of the laminations. In the alternative, only one pressure band may be used. The carriers 36 may be rotated by other means than drive mechanism 70 such as a hydraulic motor or a hydraulic piston. The rotation may also be achieved manually by using an appropriate lever or transmission mechanism known in the art. Both the carriers 36 may be actively rotated at one or both ends by an appropriate drive mechanism. Alternatively, all carriers 36 may be non-rotatable and clamps 40 may be rotated with respect to the carriers for the bending of laminations held by the clamps.

The rotatable carriers 36 may be positioned on supporting beams 34 at an angle to each other for the production of 3-dimensionally curved laminates instead of parallel to each other as in the preferred embodiment described above. In fact, the angle enclosed by the carrier 36 may be adjustable for the achievement of helical laminates of different slope. Alternatively, one or both of the clamps 40 may extend the whole length of carriers 36 so that the laminates may be positioned in the clamps 40 at different angles to carriers 36 without having to move one or both clamps 40 along carriers 36.

Other means than the inflatable air bags 50 may be used to force the pressure plate 49 against the laminations held in clamp 40. Thus, pressure plate 49 may be hydraulically or mechanically pressed against the laminations.

The mutual sliding of the pressure bands may be inhibited in other ways than by an increase in clamping pressure. For example, a magnetic field may be used to pull steel pressure bands against each other or against parts of clamps 40 in order to prevent the required friction for inhibiting the sliding movement.

In another preferred embodiment, drive assembly 70 may be omitted altogether and the torque required for the rotation of clamps 40 and the bending of laminations 64 may be provided only by the weight of clamps 40, pressure bands 60 and laminations 64. To this end, the clamps 40 are made of steel and may be hollow to be filled with water for additional weight. The clamps are also hinged so that their axis of rotation is located parallel to a central plane of the laminations and on their outer sides, which are directed away from each other. The clamps are also hinged so that their weight is positioned above the laminations. Thus, all the weight of the clamps may be used for the bending and pressing operation. The lower pressure band is bolted to the clamps to provide a fixed circumference for the bent laminate. The other pressure band is slidably held in the clamps and is provided with stops, which come to rest against the clamps during the bending operation in order to limit the sliding movement of the pressure band. An apparatus of such a construction may be used for the bending and laminating of wooden structural beams, which are used for supporting, for example, roof structures of hangars or sheds. During operation of such an embodiment, the laminations are stacked on the lower, bolted-on pressure band with the laminations and the band being horizontally supported. Subsequently, the upper pressure band is positioned on top of the laminations and the clamps, which are held in a horizontal position, are closed. Then, the clamps are released and the laminations and pressure bands are simultaneously allowed to sag freely between the clamps and the weight of the clamps, the laminations and the pressure bands provides for a bending of the laminations. The upper pressure band slides through the clamps until the stops engage the clamps at which point the momentum of the rotating clamps and the sagging laminations and pressure bands is converted into a force compressing the laminations until all momentum is converted and the desired bending and compression of the laminations is achieved. It will be readily apparent to the person skilled in the art that extremely large forces are required for the bending of structural beams due to their large dimensions. Thus, the weight and material of the clamps and pressure bands must be appropriately selected so that the required forces may be achieved. At the same time, the clamps and pressure bands must be capable of withstanding the large forces created.

It will be further apparent to the art skilled workman that an apparatus in accordance with the invention may be used not only to produce curved laminates made of a number of different materials such as wood, resin reinforced fiberglass, metal, plastic, etc. or combinations thereof, but also for the bending of one or more flexible layers which are subsequently fastened to each other or to a curved workpiece, for example, by stapling or welding.

Thus, the invention provides an apparatus and method for the production of curved laminates having an arcuate, helical, oval, elliptical, hyperbolic or similar curvature, obviating the use of a mold, form, or adjustable jig for the bending of the laminate.

Changes and modifications in the specifically described embodiments can be carried out without departing from the scope of the invention which is intended to be limited only by the scope of the appended claims.

We claim:

1. An apparatus for producing a bent laminate of at least two continuous laminations of a flexible material, comprising:

first and second clamping means for clamping together the laminations at spaced apart clamping locations;

means for rotatably supporting the clamping means, the first and second clamping means being respectively rotatable around first and second axes of rotation, at least one of the clamping means being movably supported for movement towards and from the other clamping means;

means for selectively rotating at least one of the clamping means to permit bending of laminations held by the clamping means; and means for selectively preventing mutual sliding movement of the laminations, the axes of rotation being positioned so that the bending of the laminations when the mutual sliding movement is prevented, forces the laminations against each other at a substantially evenly distributed force between the clamping locations, the laminations being of sufficient strength to withstand the force created.

2. An apparatus as defined in claim 1, further comprising:

a flexible pressure band, the first and second clamping means permitting clamping of the laminations to the pressure band at spaced apart locations, rotation of the clamping means permitting bending of the laminations clamped to the pressure band; and the means for selectively preventing a mutual sliding movement preventing a mutual sliding movement of the laminations and the pressure band, the axes of rotation being positioned so that bending of the laminations and the pressure plate while the mutual sliding movement is prevented forces the pressure plate against the laminations at a substantially evenly distributed force between the clamping locations.

3. An apparatus as defined in claim 2, wherein a pair of pressure bands is provided for clamping layers of a laminate therebetween, and the means for selectively preventing the sliding movement prevents the mutual sliding movement of the pressure bands, so that a bending of the laminations and the pressure plates, forces the pressure plates against each other, thereby compressing the laminations.

4. An apparatus as defined in claims 1, 2 or 3, wherein the means for rotatably supporting the clamping means is a frame having first and second horizontal rotatable carriers supporting the first and second clamping means respectively.

5. An apparatus as defined in claim 4, wherein at least one of the first and second carriers is slidably mounted to the frame for movement to and from the other of the first and second carriers.

6. An apparatus as defined in claim 5, wherein the means for selectively rotating at least one clamping means includes for each clamping means to be rotated a rotatable shaft, means for rotating the shaft and a lever rigidly affixed with its respective ends to the shaft and to one of the first and second carriers so that rotation of the shaft rotates the clamping means supported by the one carrier around its axis of rotation.

7. An apparatus as defined in claim 6, wherein the means for rotating the shaft is an electric motor providing a torque, the electric motor being connected to the shaft through a transmission for increasing the torque.

8. An apparatus as defined in claim 1, wherein the means for selectively preventing mutual sliding movement of the laminations controls a clamping force of at least one of the first and second clamping means to selectively clamp the layers at a low clamping force permitting mutual sliding movement of the laminations and at a high clamping force preventing the mutual sliding movement of the laminations.

9. An apparatus as defined in claim 8, wherein the clamping force of one of the first and second clamping means is controlled to prevent the mutual sliding movement of the laminations and the clamping force of the other clamping means is controlled to selectively clamp the laminations at one of the high and low clamping force.

10. An apparatus as defined in claims 8 or 9, wherein the first and second clamping means are provided with means for preventing one of an innermost and an outermost of the laminations from sliding through the clamping means at both the low clamping force and the high clamping force.

11. An apparatus as defined in claims 2 or 3, wherein the means for selectively rotating at least one clamping means includes for each clamping means to be rotated a rotatable shaft, means for rotating the shaft and a lever rigidly affixed with its respective ends to the shaft and to one of the first and second carriers so that rotation of the shaft rotates clamping means supported by the one carrier around its axis of rotation.

12. An apparatus as defined in claim 11, wherein the means for selectively preventing mutual sliding movement of the laminations and the pressure bands controls a clamping force of at least one of the first and second clamping means to selectively clamp the laminations and the pressure bands at a low clamping force permitting mutual sliding movement of the laminations and the pressure bands and a high clamping force preventing the mutual sliding movement.

13. An apparatus as defined in claim 11, wherein the clamping force of one of the first and second clamping means is controlled to prevent the mutual sliding movement and the clamping force of the other clamping means is controlled to selectively clamp the laminations and the pressure bands at the high and the low clamping force.

14. An apparatus as defined in claim 12, wherein the first and second clamping means are provided with means for preventing one pressure band from sliding through the clamping means at both the high and the low clamping force.

15. An apparatus as defined in claim 10, wherein the means for preventing one lamination from sliding through the clamping means are incorporated into the clamping means and forced into engagement with the one lamination.

16. An apparatus as defined in claim 10, wherein the means for preventing one pressure band from sliding through the clamping means are spurs incorporated into the clamping means and forced into engagement with the one pressure band.

17. An apparatus as defined in claims 1, 2 or 3, wherein at least one of the two clamping means is movable parallel to its axis of rotation.

18. An apparatus as defined in claim 8, wherein at least one of the two clamping means is movable parallel to its axis of rotation.

19. A method of producing a bent laminate having at least two continuous flexible laminations comprising the steps of:

clamping together the laminations at spaced apart clamping locations and at a clamping force permitting mutual sliding movement of the laminations;

bending the layers between the clamping locations to a radius of curvature larger than a desired radius of curvature;

increasing the clamping force at the clamping locations to prevent the mutual sliding movement; and further bending the layers to the desired radius of curvature so that the laminations are forced against each other at an even pressure along the curvature, the laminations being of sufficient strength to withstand the pressure created.

20. A method of producing a bent laminate having at least two continuous, flexible laminations, comprising the steps of:

clamping the laminations to a pressure band at spaced apart clamping locations and at a clamping force permitting mutual sliding movement of the laminations and the pressure band;

bending the laminations and the pressure band between the clamping locations to a radius of curvature larger than a desired radius of curvature;

increasing the clamping force at the clamping locations to prevent the mutual sliding movement of the laminations and the pressure band; and further bending the layers to the desired radius of curvature so that the pressure band is forced against the laminations between the clamping locations at an evenly distributed pressure force, the laminations being of sufficient strength to withstand the pressure created.

21. A method of producing a bent laminate having at least two flexible laminations, comprising the steps of:

clamping the laminations between a pair of pressure bands at spaced apart clamping locations and at a clamping force permitting a mutual sliding movement of the pressure bands;

bending the laminations and the pressure bands between the clamping locations to a radius of curvature larger than a desired radius of curvature;

increasing the clamping force at the clamping locations to prevent the mutual sliding movement of the pressure bands; and further bending the laminations and the pressure bands to the desired radius of curvature so that the pressure bands are forced against each other and compress the layers between the clamping locations at an evenly distributed pressure force.

* * * * *